US007694842B2

(12) United States Patent
Melrose

(10) Patent No.: US 7,694,842 B2
(45) **Date of Patent: *Apr. 13, 2010**

(54) CONTAINER HAVING PRESSURE RESPONSIVE PANELS

(76) Inventor: David Murray Melrose, 90 Balmoral Rd., Mt Eden, Auckland (NZ)

( * ) Notice: Subject to any disclaimer, the term of this patent is extended or adjusted under 35 U.S.C. 154(b) by 470 days.

This patent is subject to a terminal disclaimer.

(21) Appl. No.: 11/529,012

(22) Filed: Sep. 27, 2006

(65) Prior Publication Data

US 2007/0017892 A1 Jan. 25, 2007

Related U.S. Application Data

(63) Continuation of application No. 09/689,957, filed on Oct. 12, 2000, now Pat. No. 7,137,520.

(30) Foreign Application Priority Data

Feb. 25, 1999 (NZ) ..... 334372
Feb. 24, 2000 (NZ) ..... PCT/NZ00/00019

(51) Int. Cl.
*B65D 90/02* (2006.01)

(52) U.S. Cl. ..... 220/666; 220/675; 215/381

(58) Field of Classification Search ..... 215/379, 215/381; 220/609, 666, 669, 675
See application file for complete search history.

(56) References Cited

U.S. PATENT DOCUMENTS 3,325,031 A 6/1967 Singier
4,037,752 A 7/1977 Dulmaine et al.
4,372,455 A 2/1983 Cochran
4,387,816 A 6/1983 Weckman
4,497,855 A 2/1985 Agrawal et al.
4,805,788 A 2/1989 Ota
4,877,141 A 10/1989 Hayashi et al.
5,064,081 A 11/1991 Hayashi et al.
5,141,121 A 8/1992 Brown et al.
5,178,290 A 1/1993 Ota et al.
5,238,129 A 8/1993 Ota
5,279,433 A 1/1994 Krishnakumar et al.
5,303,834 A 4/1994 Krishnakumar et al.
5,341,946 A 8/1994 Vailliencourt
5,392,937 A * 2/1995 Prevot et al. ..... 215/400

(Continued)

FOREIGN PATENT DOCUMENTS

EP 0505054 9/1992

(Continued)

OTHER PUBLICATIONS

European Patent Office, Supplementary European Search Report Corresponding to EP publication No. EP1163161, Aug. 31, 2000, pp. 1-2.

*Primary Examiner*—Harry A Grosso
(74) *Attorney, Agent, or Firm*—Henricks, Slavin & Holmes LLP

(57) ABSTRACT

A container, suitable as a hot-fill container, includes a controlled deflection flex panel which may invert and flex under pressure, such as hot-fill conditions, to avoid deformation and permanent buckling of the container. The flex panel includes an initiator portion which has a lesser projection than the remainder of the flex panel and initiates deflection of the flex panel.

19 Claims, 9 Drawing Sheets

U.S. PATENT DOCUMENTS

| | | | |
|---|---|---|---|
| 5,704,503 | A | 1/1998 | Krishnakumar et al. |
| 5,908,128 | A | 6/1999 | Krishnakumar et al. |
| 5,971,184 | A | 10/1999 | Krishnakumar et al. |
| 6,036,037 | A | 3/2000 | Scheffer et al. |
| 6,112,925 | A | 9/2000 | Nahill et al. |
| 6,779,673 | B2 | 8/2004 | Melrose et al. |
| 7,137,520 | B1 | 11/2006 | Melrose |

FOREIGN PATENT DOCUMENTS

| | | | |
|---|---|---|---|
| FR | 2187617 | A | 1/1974 |
| FR | 2743050 | | 7/1997 |

* cited by examiner

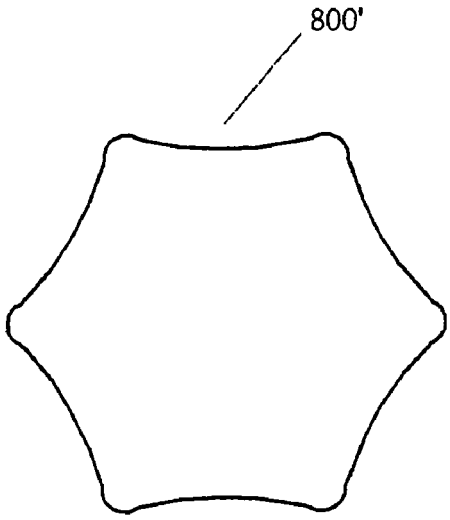
FIG10a (E-E)
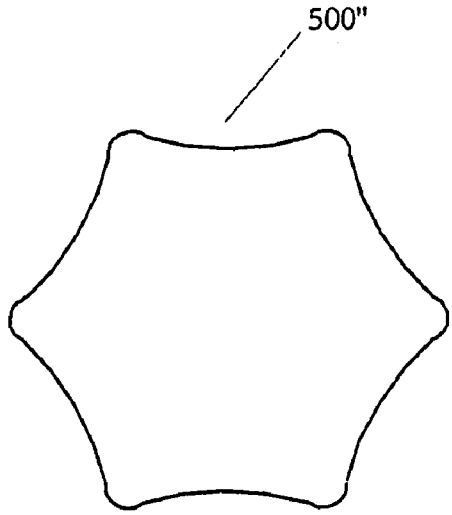
FIG10b (F-F)

Pressure Step 1
(B-B)

Pressure Step 2
(B-B)

Pressure Step 3
(B-B)

Pressure Step 4
(B-B)

CONTAINER HAVING PRESSURE RESPONSIVE PANELS

RELATED APPLICATIONS

This application is a continuation of U.S. application Ser. No. 09/689,957, entitled Container Having Pressure Responsive Panels, filed Oct. 12, 2000 now U.S. Pat. No. 7,137,520, which is related to, and claims priority from, New Zealand Patent Application, entitled A Container Having A Pressure Responsive Panels filed on Feb. 25, 1999, Application No. 334372; and which is a continuation of, and claims priority from Patent Cooperation Treaty Application, entitled A Container Having A Pressure Responsive Panels, filed on Feb. 24, 2000, International Application No. PCT/NZ00/00019, which are fully incorporated herein by reference.

TECHNICAL FIELD

This invention relates to a pressure adjustable container and more particularly to polyester containers capable of being filled with hot liquid, and an improved side wall construction for such containers.

BACKGROUND OF THE INVENTION

'Hot-Fill' applications impose significant and complex mechanical stress on a container structure due to thermal stress, hydraulic pressure upon filling and immediately after capping, and vacuum pressure as the fluid cools.

Thermal stress is applied to the walls of the container upon introduction of hot fluid. The hot fluid will cause the container walls to soften and then shrink unevenly, causing distortion of the container. The polyester must therefore be heat-treated to induce molecular changes resulting in a container that exhibits thermal stability.

Pressure and stress are acted upon the side walls of a heat resistant container during the filling process, and for a significant period of time thereafter. When the container is filled with hot liquid and sealed, there is an initial hydraulic pressure and an increased internal pressure is placed upon containers. As the liquid, and the air headspace under the cap, subsequently cool, thermal contraction results in partial evacuation of the container. The vacuum created by this cooling tends to mechanically deform the container walls.

Generally speaking, containers incorporating a plurality of longitudinal flat surfaces accommodate vacuum force more readily. Agrawal et al, U.S. Pat. No. 4,497,855 discloses a container with a plurality of recessed collapse panels, separated by land areas, which allows uniformly inward deformation under vacuum force. The vacuum effects are controlled without adversely affecting the appearance of the container. The panels are drawn inwardly to vent the internal vacuum and so prevent excess force being applied to the container structure, which would otherwise deform the inflexible post or land area structures. The amount of 'flex' available in each panel is limited, however, and as the limit is approached there is an increased amount of force that is transferred to the side walls.

To minimise the effect of force being transferred to the side walls, much prior art has focused on providing stiffened regions to the container, including the panels, to prevent the structure yielding to the vacuum force.

The provision of horizontal or vertical annular sections, or 'ribs', throughout a container has become common practice in container construction, and is not only restricted to hot-fill containers. Such annular sections will strengthen the part they are deployed upon. Cochran U.S. Pat. No. 4,372,455 discloses annular rib strengthening in a longitudinal direction, placed in the areas between the flat surfaces that are subjected to inwardly deforming hydrostatic forces under vacuum force. Akiho Ota et al U.S. Pat. No. 4,805,788 discloses longitudinally extending ribs alongside the panels to add stiffening to the container. Akiho Ota also discloses the strengthening effect of providing a larger step in the sides of the land areas. This provides greater dimension and strength to the rib areas between the panels. Akiho Ota et al, U.S. Pat. No. 5,178,290 discloses indentations to strengthen the panel areas themselves.

Akiho Ota et al, U.S. Pat. No. 5,238,129 discloses further annular rib strengthening, this time horizontally directed in strips above and below, and outside, the hot-fill panel section of the bottle.

In addition to the need for strengthening a container against both thermal and vacuum stress, there is a need to allow for an initial hydraulic pressure and increased internal pressure that is placed upon a container when hot liquid is introduced followed by capping. This causes stress to be placed on the container side wall. There is a forced outward movement of the heat panels, which can result in a barrelling of the container.

Thus, Hayashi et al, U.S. Pat. No. 4,877,141, discloses a panel configuration that accommodates an initial, and natural, outward flexing caused by internal hydraulic pressure and temperature, followed by inward flexing caused by the vacuum formation during cooling. Importantly, the panel is kept relatively flat in profile, but with a central portion displaced slightly to add strength to the panel but without preventing its radial movement in and out. With the panel being generally flat, however, the amount of movement is limited in both directions. By necessity, panel ribs are not included for extra resilience, as this would prohibit outward and inward return movement of the panel as a whole.

Krishnakumar et al, U.S. Pat. No. 5,908,128 discloses another flexible panel that is intended to be reactive to hydraulic pressure and temperature forces that occur after filling. Relatively standard 'hot-fill' style container geometry is disclosed for a 'pasteurizable' container. It is claimed that the pasteurization process does not require the container to be heat-set prior to filling, because the liquid is introduced cold and is heated after capping. Concave panels are used to compensate for the pressure differentials. To provide for flexibility in both radial outward movement followed by radial inward movement however, the panels are kept to a shallow inward-bow to accommodate a response to the changing internal pressure and temperatures of the pasteurization process. The increase in temperature after capping, which is sustained for some time, softens the plastic material and therefore allows the inwardly curved panels to flex more easily under the induced force. It is disclosed that too much curvature would prevent this, however. Permanent deformation of the panels when forced into an opposite bow is avoided by the shallow setting of the bow, and also by the softening of the material under heat. The amount of force transmitted to the walls of the container is therefore once again determined by the amount of flex available in the panels, just as it is in a standard hot-fill bottle. The amount of flex is limited, however, due to the need to keep a shallow curvature on the radial profile of the panels. Accordingly, the bottle is strengthened in many standard ways.

Krishnakumar et al, U.S. Pat. No. 5,303,834 discloses still further 'flexible' panels that can be moved from a convex position to a concave position, in providing for a 'squeezable' container. Vacuum pressure alone cannot invert the panels, but they can be manually forced into inversion. The panels automatically 'bounce' back to their original shape upon release of squeeze pressure, as a significant amount of force is required to keep them in an inverted position, and this must be maintained manually. Permanent deformation of the panel, caused by the initial convex presentation, is avoided through the use of multiple longitudinal flex points.

Krishnakumar et al, U.S. Pat. No. 5,971,184 discloses still further 'flexible' panels that claim to be movable from a convex first position to a concave second position in providing for a grip-bottle comprising two large, flattened sides. Each panel incorporates an indented 'invertible' central portion. Containers such as this, whereby there are two large and flat opposing sides, differ in vacuum pressure stability from hot-fill containers that are intended to maintain a generally cylindrical shape under vacuum draw. The enlarged panel side walls are subject to increased suction and are drawn into concavity more so than if each panel were smaller in size, as occurs in a 'standard' configuration comprising six panels on a substantially cylindrical container. Thus, such a container structure increases the amount of force supplied to each of the two panels, thereby increasing the amount of flex force available.

Even so, the convex portion of the panels must still be kept relatively flat, however, or the vacuum force cannot draw the panels into the required concavity. The need to keep a shallow bow to allow flex to occur was previously described by Krishnakumar et al in both U.S. Pat. No. 5,303,834 and U.S. Pat. No. 5,908,128. This in turn limits the amount of vacuum force that is vented before strain is placed on the container walls. Further, it is generally considered impossible for a shape that is convex in both the longitudinal and horizontal planes to successfully invert, anyhow, unless it is of very shallow convexity. Still further, the panels cannot then return back to their original convex position again upon release of vacuum pressure when the cap is removed if there is any meaningful amount of convexity in the panels. At best, a panel will be subject to being 'force-flipped' and will lock into a new inverted position. The panel is then unable to reverse in direction as there is no longer the influence of heat from the liquid to soften the material and there is insufficient force available from the ambient pressure. Additionally, there is no longer assistance from the memory force that was available in the plastic prior to being flipped into a concave position. Krishnakumar et al U.S. Pat. No. 5,908,128 previously disclose the provision of longitudinal ribs to prevent such permanent deformation occurring when the panel arcs are flexed from a convex position to one of concavity. This same observation regarding permanent deformation was also disclosed in Krishnakumar et al U.S. Pat. No. 5,303,834. Hayashi et al U.S. Pat. No. 4,877,141 also disclosed the necessity of keeping panels relatively flat if they were to be flexed against their natural curve.

The principal mode of failure in prior art containers is believed by the applicant to be non-recoverable buckling of the structural geometry of the container, due to weakness, when there is a vacuum pressure inside the container, and especially when such a container has been subjected to a lowering of the material weight for commercial advantage.

The present invention in contrast, allows for increased flexing of the vacuum panel side walls so that the pressure on the containers may be more readily accommodated. Reinforcing ribs of various types and location may still be used, as described above, to still compensate for any excess stress that must inevitably be present from the flexing of the container walls into the new 'pressure-adjusted' condition by ambient forces.

OBJECT OF THE INVENTION

Thus, it is an object of the invention to overcome or at least alleviate such problems in containers at present or at least to provide the public with a useful choice.

Further objects of the present invention may become apparent from the following description.

SUMMARY OF THE INVENTION

According to one aspect of the present invention, there is provided a container having a central longitudinal axis, said container including at least one invertible flexible panel, said flexible panel having at least a portion projecting in a direction from a plane, said plane disposed relative to said longitudinal axis, said flexible panel also including at least one initiator portion projecting to a lesser extent in said direction, whereby in use, deflection of the initiator portion causes the remainder of the flexible panel to deflect.

In one preferred form, the projection is in an outward direction relative to the plane.

In another preferred form, the projection is in an inward direction relative to the plane.

In one preferred form, the flexible panel may be substantially arcuate.

In an alternative form, the flexible panel may include two flexible panel portions meeting at an apex.

Preferably, the flexible panel may be located between relatively inflexible land areas.

In one preferred form, the or each initiator portion may be located substantially at an end of said flexible panel.

In an alternative preferred form, the initiator portion may be located substantially towards a centre of said flexible panel.

Preferably, the or each initiator portion may include a substantially flattened portion.

Preferably, the flattened portion may be located at a distal end of said initiator portion relative to the rest of the flexible panel.

In one preferred form, the or each initiator portion may project in an opposite direction to the remainder of the flexible panel.

Preferably, a boundary between said initiator portion and the remainder of said flexible panel may be substantially arcuate in the circumferential direction of the panel.

In one preferred form, the extent of projection of the flexible panel may progressively increase away from said initiator portion.

In an alternative form, the extent of projection of the flexible panel may remain substantially constant away from said initiator portion.

Preferably, the container may include a connector portion between said flexible panel and said land areas, the connector portion adapted to locate said flexible panel and said land areas at a different circumference relative to a centre of the container.

Preferably, the connector portion may be substantially "U"-shaped, wherein the side of the connector portion towards the flexible panel is adapted to flex, substantially straightening the "U"-shape when the flexible panel is in a first position and return to the "U"-shape when the flexible panel is inverted from the first position.

Preferably, the extent of projection of the initiator portion may be adapted to allow deflection of the initiator portion upon cooling of a predetermined liquid introduced to the container at a predetermined temperature.

Preferably, the flexible panel may be adapted to invert in use upon deflection of the initiator portion.

According to another aspect of the present invention, there is provided a controlled deflection flex panel, having an initiator region of a predetermined extent of projection and a flexure region of a greater extent of projection extending away from said initiator region, whereby flex panel deflection occurs in a controlled manner in response to changing container pressure.

According to a further aspect of the present invention, there is provided a controlled deflection flex panel for a hot-fillable container having a portion with an initiator region of predetermined extent of projection and a flexure region of progressively increasing extent of projection extending away from said initiator region, said wall being outwardly bowed between said regions, whereby flex panel deflection occurs progressively between said regions in a controlled manner in response to changing container pressure.

Preferably, a flattened region may extend between said inflexible regions to provide an end portion of said initiator portion.

According to another aspect of the present invention, there is provided a controlled deflection flex panel, having an initiator region of a predetermined extent of projection and a flexure region having a lesser extent of projection in an opposite direction to the initiator region, the flexure region extending away from said.initiator region, whereby flex panel deflection occurs in a controlled manner in response to changing container pressure.

According to a further aspect of the present invention, there is provided a controlled deflection flex panel for a hot-fillable container having a portion with an initiator region of predetermined extent of projection and a flexure region of progressively decreasing extent of projection extending away from said initiator region, said wall being inwardly bowed between said regions, whereby flex panel deflection occurs progressively between said regions in a controlled manner in response to changing container pressure.

In one preferred form, the initiator region and/or flexure region may be substantially arcuate.

In an alternate preferred form, the initiator region and/or flexure region may include two panel portions meeting at an apex.

Further aspects of the invention may become apparent from the following description given by way of example only and in which reference is made to the accompanying drawings.

BRIEF DESCRIPTION OF THE DRAWINGS

FIG. 10*a* & FIG. 10*b*: show cross sectional views along lines EE and FF in FIG. 8*b*.

DETAILED DESCRIPTION OF THE DRAWINGS

Figure 1:
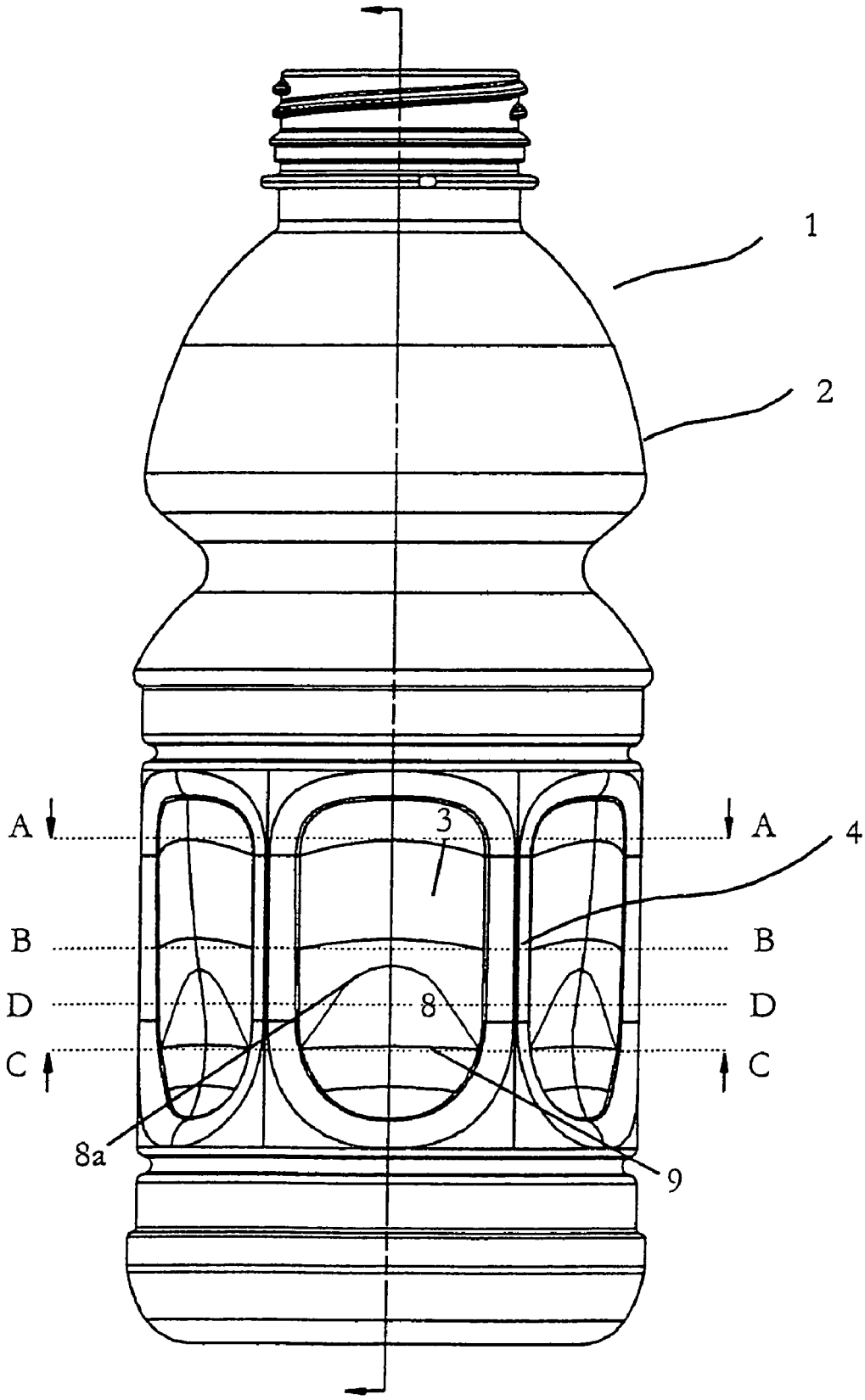
FIG. 1: shows an elevational view of a container according to one possible embodiment of the present invention.

Referring to FIG. 1, according to a preferred form of the present invention, a container is indicated generally at 1 as having a main side wall portion 2 of generally round cylindrical shape.

The container 1 is a pressure-adjustable container, in particular a 'hot-fill' container that is adapted to be filled with a liquid at a temperature above room temperature. The container 1 may be formed in a blow mould and may be produced from a polyester or other plastic material, such as a heat set polyethylene terepthalate (PET). The lower part of side wall portion 2 includes a plurality of vertically oriented elongated vacuum panels 3 which are disposed about the circumference of the container, spaced apart from one another by smooth vertically elongated land areas 4. Each panel may be generally rectangular in shape and is adapted to flex inwardly upon filling the container with a hot-fill liquid, capping the container, and subsequent cooling of the liquid. During the process the vacuum panels 3 operate to compensate for the hot-fill vacuum.

Figure 2A:
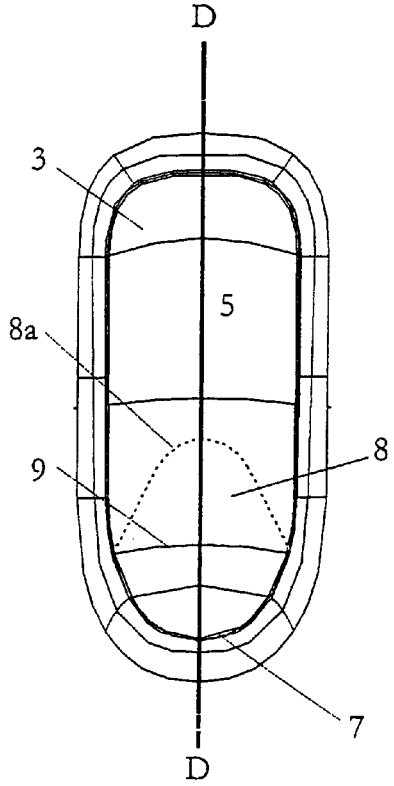
FIG. 2*a*: shows an elevational panel section of the container shown in FIG. 1.

Referring now to FIG. 2*a*, a vacuum panel 3 of container 1 is shown. The vacuum panel 3 includes at least one connecting portion 7 that connects a projecting portion 5 to the land areas 4. The projecting portion 5 includes an initiator portion 8, which controls ajunction of the projecting portion 5 and the connecting portion 7. Preferably, the connecting portion 7 is capable of flexing inwardly under vacuum force with relative ease and the initiator portion 8 causes the projecting portion 5 to deflect by both inverting and then flexing further inwardly. This causes far greater evacuation of volume from the vacuum panels 3 than existing flex-panels. Vacuum pressure is subsequently reduced to a greater degree than in existing containers causing less stress to be applied to the container side walls.

Preferably, the connecting portion 7 allows for the radius from the centre of the container 1 at the edge of the flex panel 3 (inside of the connecting portion 7) to be set independently of the radius at the edge of the land areas 4 (outside border surrounding the connecting portion 7). Thus, the connecting portion 7 allows for the land area 4 to be independently complete on one side, and for the flex panel 3 to be complete, and optimised for deflection on the other side. The connecting portion 7 bridges any circumferential radial difference between the two structures.

The boundary 8A between the initiator portion 8 and the rest of the projecting portion 5 is shown as being itself substantially arcuate in the circumferential direction of the panel 3.

The amount of arc or projection of the initiator portion 8 relative to a plane defined by the central longitudinal axis of the container is significantly less than the arc or projection of the projecting portion 5, making it more susceptible to vacuum pressure. The initiator portion 8 further includes an initiator end 9 that is predominantly flattened, and is most susceptible to vacuum pressure. Thus when the container 1 is subjected to vacuum pressure, the vacuum panel 3 may flex at initiator end portion 9 followed by deflection and then inversion of the whole initiator portion 8 and subsequent continuation of inversion of the projecting portion 5. In an alternative embodiment, the initiator end 9 may be concave. In this embodiment however, the extent of projection of the concave portion relative to a plane defined by the central longitudinal axis of the container is still less than the magnitude of the projection of the rest of the projecting portion 5.

It will be appreciated that the inversion of the projecting portion 5 may progress steadily in response to the gradual contraction of the volume of the contents of the container 1 during cooling. This is in contrast to a panel which 'flips' between two states. The gradual deflection of the projecting portion 5 to and from inversion in response to a relatively small pressure differential in comparison to panels which "flip", means that less force is transmitted to the side walls of the container 1. This allows for less material to be necessarily utilised in the container construction, making production cheaper. Consequentially, less failures under load may occur for the same amount of container material.

Furthermore, the reduced pressure differential required to invert the projecting portion 5 allows for a greater number of panels 3 to be included on a single container 1. The panel 3 also does not need to be large in size, as it provides for a low vacuum force to initiate panel flex. Thus, the panels 3 do not need to be large in size, nor reduced in number on a container structure, providing more flexibility in container design.

Figure 2B:
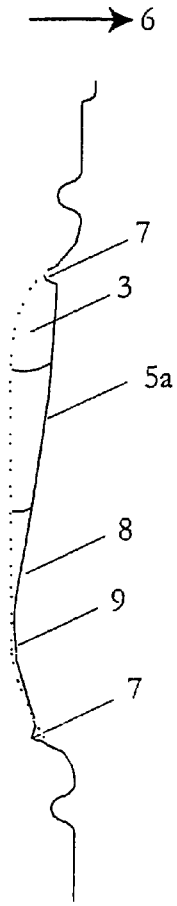
FIG. 2*b*: shows a side view of the panel section shown in FIG. 2*a*.

FIG. 2*b* shows a cross-section along line DD in FIG. 2*a*. The panel 3 is shown with projecting portion 5 in its non-inverted position, the dotted line indicating the boundary of the projecting portion 5 with the connecting portion 7. In the preferred form of the invention, the projecting portion 5 is substantially arcuate in an outwardly radial or transverse direction, as indicated by direction arrow 6. The connector portion 7 is substantially "U"-shaped, with the relative heights of the sides of the "U" determining the relative radius at which the land areas 4 and projecting portion 5 are positioned. The initiator end 9 is most susceptible to vacuum pressure due to projecting to the least extent i.e. having the smallest arc of the projecting portion 5.

Figure 3:
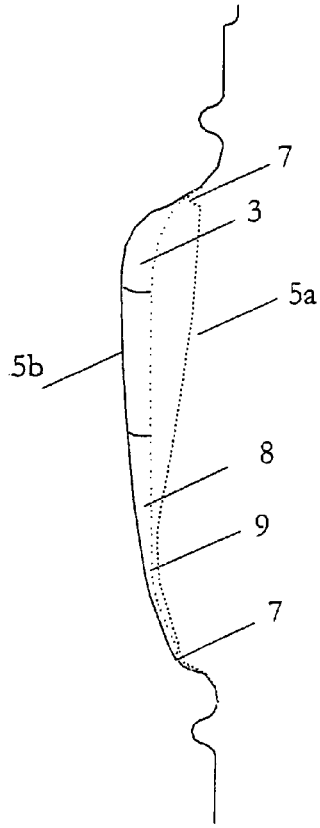
FIG. 3: shows a side view of the panel section shown in FIG. 2*b* inverted.

FIG. 3 shows a panel 3 with the projecting portion 5 inverted due to applied vacuum pressure. The initiator end 9 and initiator portion 8 deflect and invert first, effectively pulling the adjacent area of the projection portion 5 inwards. This continues along the projecting portion 5 until the projecting portion is fully inverted as shown at 5*b*. The dotted line in FIG. 3 shows the edge of the projection portion 5 and the dashed line 5*a* shows the position of the projecting portion 5 when not inverted.

Importantly, when the vacuum pressure is released following removal of the cap from the container, the panel 3 is able to recover from its vacuum-set position and return to its original configuration. This may be assisted by an even gradation of arc curvature from one end of the projecting portion 5 to the other, the arc of curvature progressively increasing away from the initiator portion 8. Alternatively, the projection portion 5 may have a substantially constant gradation. When the pressure is released, the initiator portion 8 causes the inwardly arcuate panel 3 to successfully reverse direction transversely, beginning with reversal of the initiator portion 8 and followed by the raised projecting portion 5 without being subject to non-recoverable buckling. The vacuum panel 3 may repeatedly invert without significant permanent deformation.

FIGS. 4*a-d* show cross-sectional representations of the container 1 shown in FIG. 1 along lines AA, BB, CC and DD respectively with the projecting portions 5 and 8 in the non-inverted position. In this preferred embodiment, the projecting portion 5 progressively projects further outward away from the initiator portion 8.

Figure 5A:
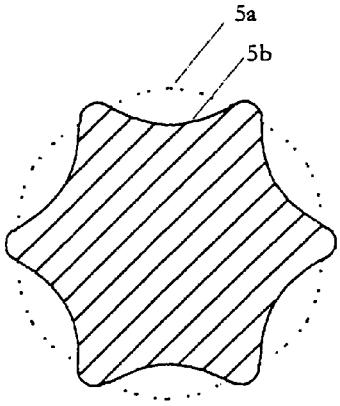
FIGS. 5*a-c*: show schematic representations of the cross-section of the container of FIG. 1 along lines A-C respectively when the panel sections are inverted.
Figure 5B:
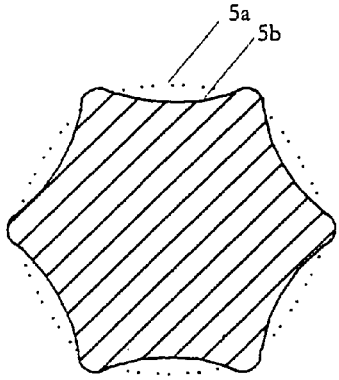
Figure 5C:
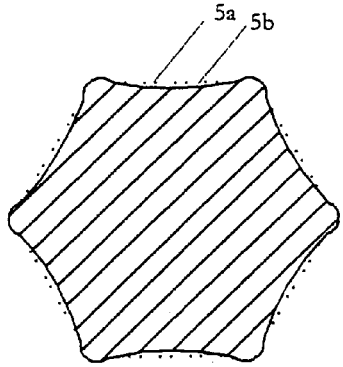

FIGS. 5*a-c* show cross-sectional representations of the container 1 along lines AA, BB, and CC respectively with the projecting portion 5 in the fully inverted position, 5*b*, due to applied vacuum pressure. The area of the projecting portion 5 around line AA deflects to a relatively large extent in comparison to areas closer to the initiator portion 8. The dotted lines 5*a* in FIGS. 5*a-c* indicate the position of the projection portions 5 without vacuum pressure.

Figure 4A:
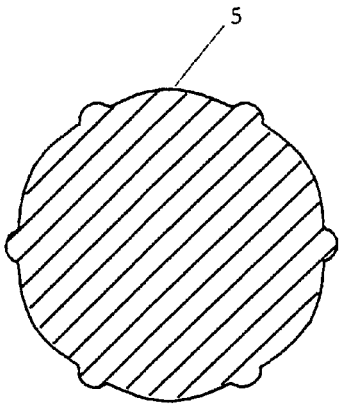
FIGS. 4*a-d*: show schematic representations of the cross-section of the container of FIG. 1 along lines A-D respectively when the panel sections are not inverted.
Figure 4B:
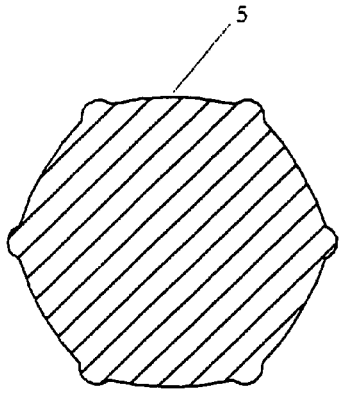
Figure 4C:
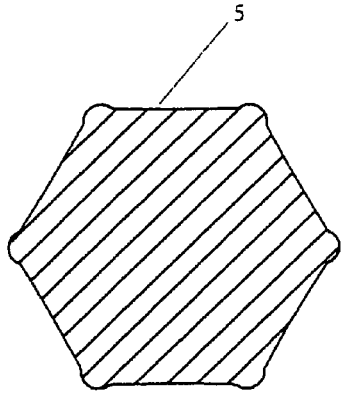
Figure 4D:
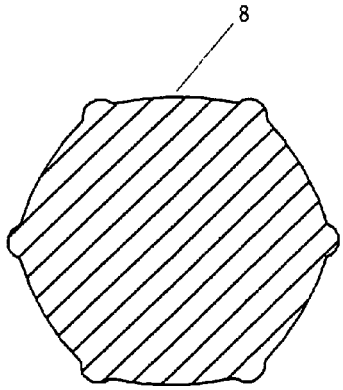
Figure 11A:
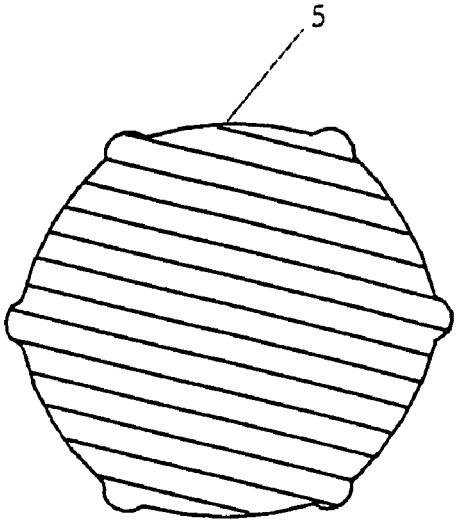
FIGS 11*a*-11*d*: show cross sections along lines BB of FIG. 1 during four different stages of pressure with the flexure region lessening in outward curvature during progressive pressure variations.
Figure 11B:
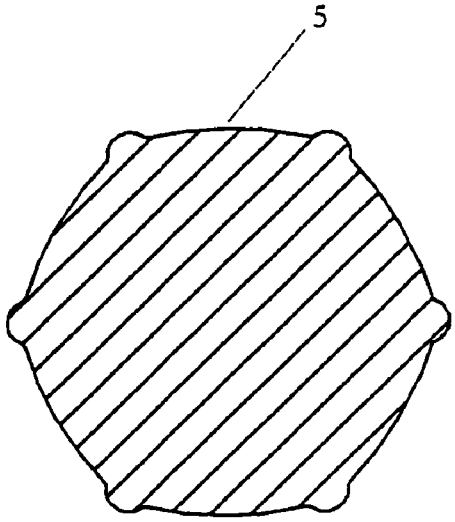
Figure 11C:
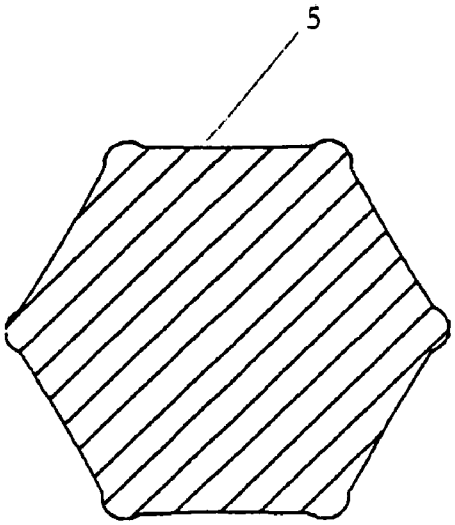
Figure 11D:
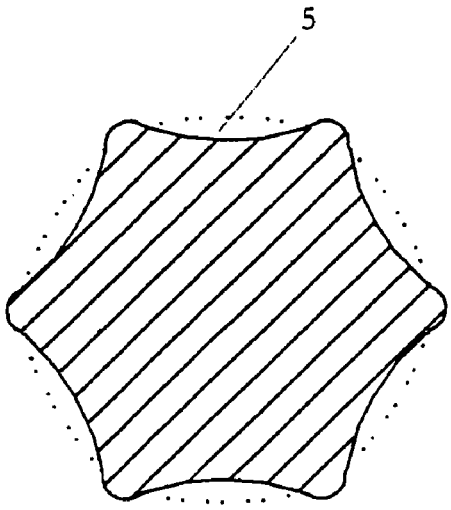

FIGS. 11*a* to 11*d* show the projection 5 of FIG. 4*b* as it lessens in outward curvature to an inverted position as shown in FIGS. 5*b* and 11*d*.

Figure 6A:
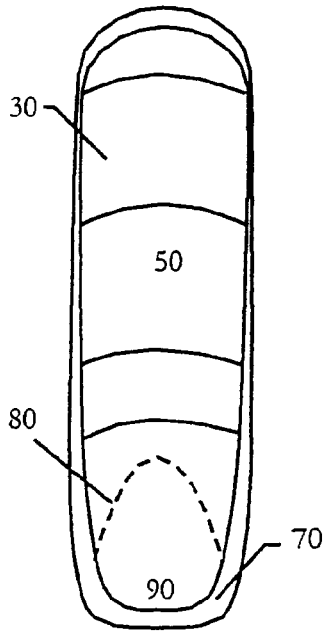
FIGS. 6*a-c*: show front and side views of an alternative embodiment of a panel section.
Figure 6B:
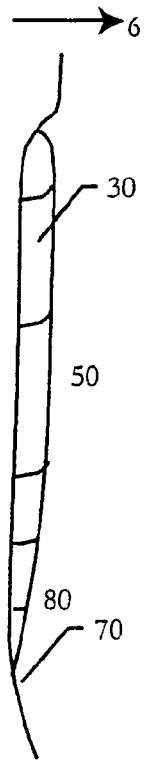
Figure 6C:
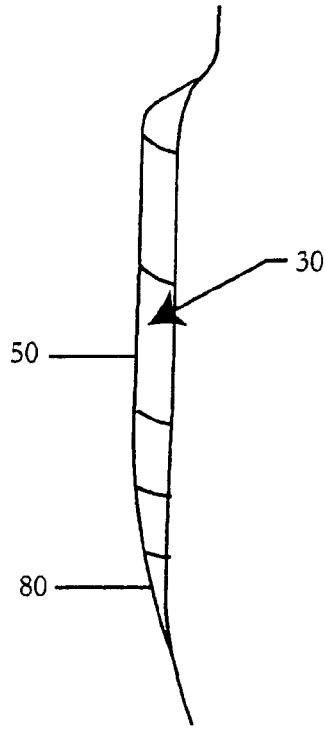

FIG. 6*a* shows an elevation of an alternative embodiment of a vacuum panel 30 with initiator portion 80 and flattened region 90. The connector portion 70 of vacuum panel 30 is a planar member surrounding the projecting portion 50. FIG. 6*b* shows the vacuum panel 30 without vacuum pressure applied. The projecting portion 50 has a substantially constant arc curvature away from the initiator region 80 in the direction of arrow 6. FIG. 6*c* shows vacuum panel 30 with its projecting portion 50 in a fully inverted position due to the application of vacuum pressure.

Figure 7A:
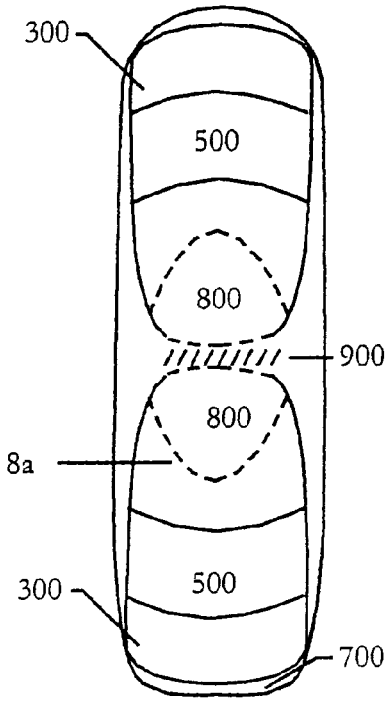
FIG. 7*a*: shows an elevational front view of a further alternative embodiment of a panel section.
Figure 7B:
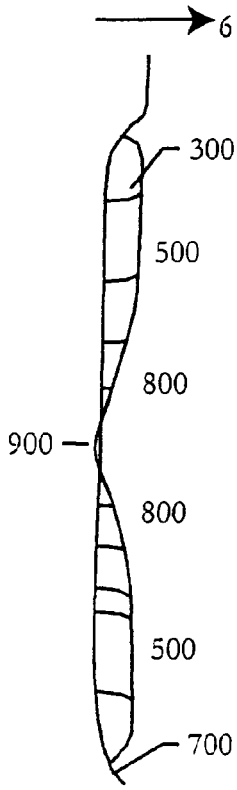
FIGS. 7*b,c*: show side views of the panel section of FIG. 7*a* in the non-inverted and inverted positions respectively.
Figure 7C:
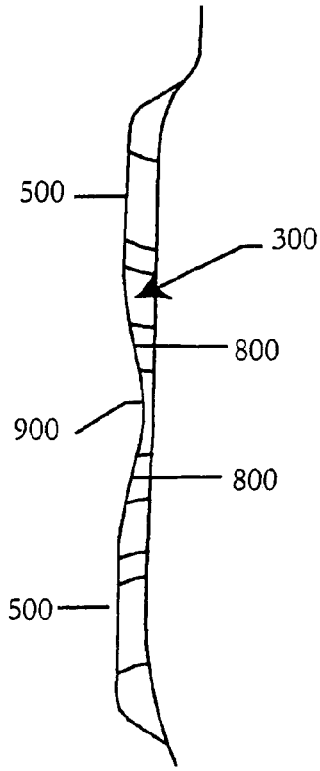

FIG. 7*a* shows an elevation of a further alternative embodiment of a vacuum panel 300. The vacuum panel 300 includes two projecting portions 500 located vertically adjacent to each other. The initiator portion 800 extends in two directions from a central initiator end 900. In this embodiment, the centre of the vacuum panel 300 is most susceptible to deflection under vacuum pressure and hence deflects first. FIGS. 7*b* and 7*c* show the vacuum panel 300 without vacuum pressure applied and in the fully inverted position respectively.

Dotted line 800*a* illustrates the arcuate boundary between the initiator portions 800 and the rest of the projecting portions 500.

Figures 8A, 8B, 8C, 8D:
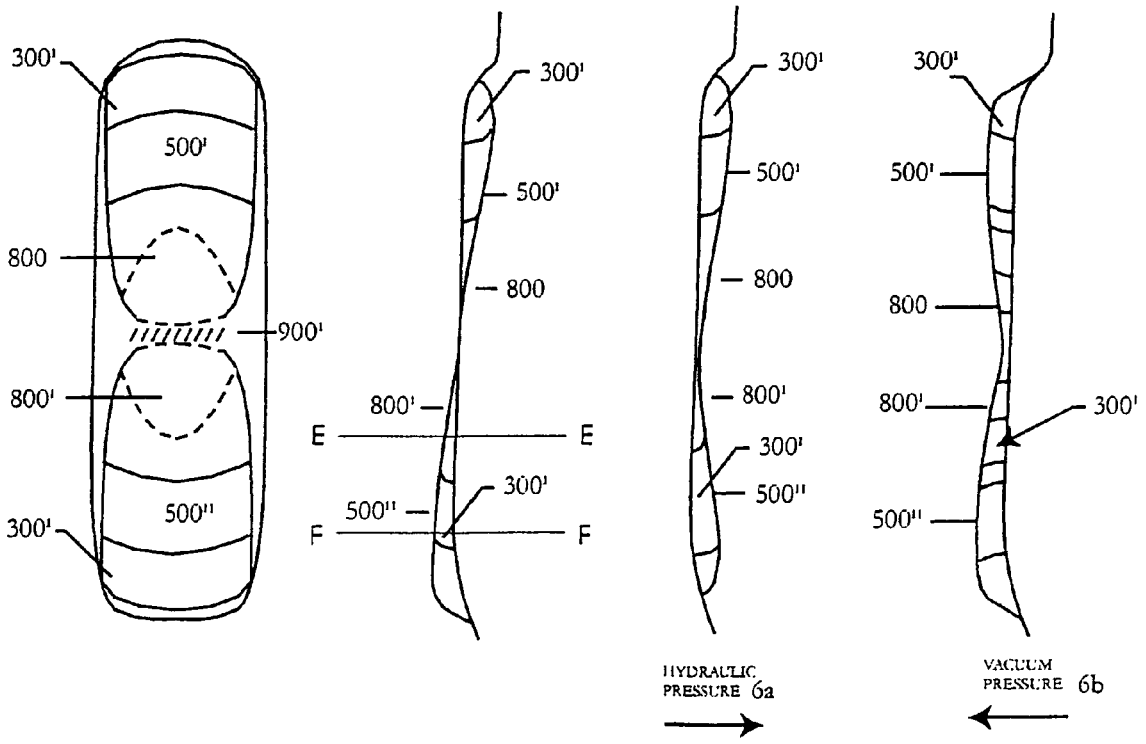
FIG. 8*a*: shows an elevational front view of a further alternative embodiment of a panel section.
FIGS. 8*b-d*: show side views of the panel section of FIG. 8*a* in a non-inverted, partly inverted and fully inverted position respectively.

FIG. 8*a* shows an elevation of a further alternative embodiment of a vacuum panel referred generally by arrow $\mathbf{300}^1$. The vacuum panel $\mathbf{300}^1$ includes two projecting portions $\mathbf{500}^1$ and $\mathbf{500}^{11}$ located vertically adjacent to each other with respective initiator portions 800 and $\mathbf{800}^1$ including a central flattened portion $\mathbf{900}^1$ between them. However, unlike vacuum panel 300, the normal position of one of the projecting portions $\mathbf{500}^{11}$ and initiator portion $\mathbf{800}^1$ is concave rather than convex (see FIGS. 8*b*, 10*a* and 10*b*). Upon application of hydraulic pressure, the concave projecting portion $\mathbf{500}^{11}$ is inverted in the direction shown by arrow 6*a* (see FIG. 8*c*), reducing pressure on land areas (4) between adjacent panels $\mathbf{300}^1$. Once the fluid cools, vacuum pressure causes both projecting portions $\mathbf{500}^1$ and $\mathbf{500}^{11}$ to invert in the direction of arrow 6B. (See FIG. 8*d*).

Figure 9A:
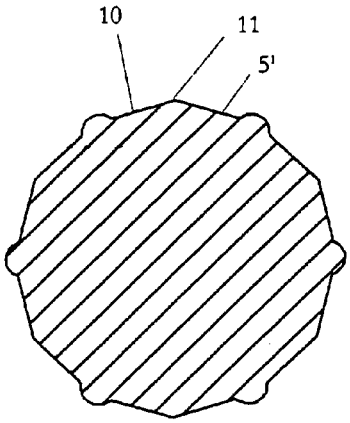
FIGS. 9*a-c* & FIGURES d-f: show schematic representations of the cross section through lines corresponding to A-C respectively of the container of FIG. 1 having a further alternative panel section respectively in the non-inverted and inverted positions.
Figure 9B:
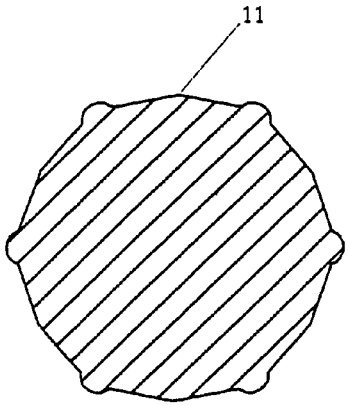
Figure 9C:
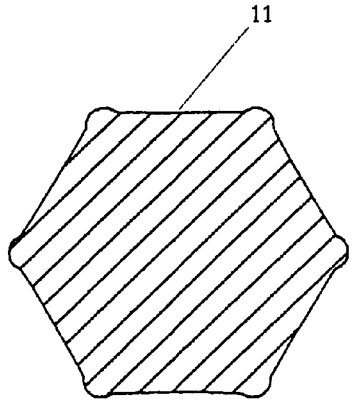
Figure 9D:
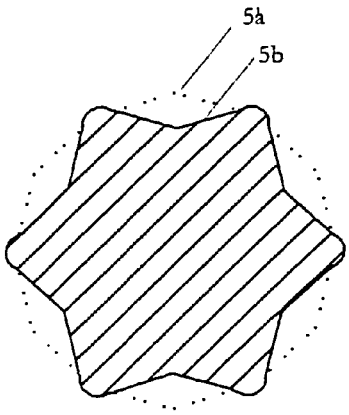
Figure 9E:
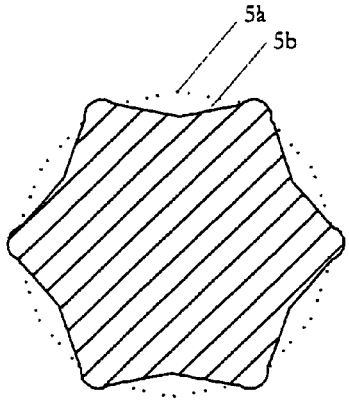
Figure 9F:
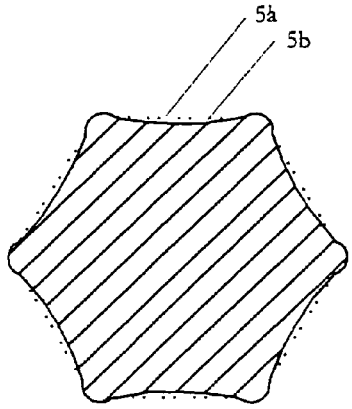

It will be appreciated that the profile and/or configuration of the vacuum panels may be varied. For example, as shown in FIG. 9, the container (1) may have vacuum panels with projecting portions $\mathbf{5}^1$ including two planar portions 10 meeting at an apex 11 so as to form an angular, as opposed to an arcuate, panel. FIGS. 9*a-c* show cross-sections along lines AA, BB and CC respectively of the container 1 of FIG. 1 but with such projecting portions $\mathbf{5}^1$. FIGS. 9*d-f* show the inverted positions of projecting portions $\mathbf{5}^1$ of FIGS. 9*a-c* respectively, with the full lines $\mathbf{5}^1 b$ showing the inverted position and the dotted lines $\mathbf{5}^1 a$ the positions before inversion. Additionally, or alternatively, the panels 3 of any of the embodiments may be disposed transversely of the longitudinal axis of the container 1 rather than vertically as shown in FIG. 1 for example.

Thus, there is provided a pressure adjustable container including flexible panels that allow for a large change in volume in the contents of the container and therefore reduced pressure being applied to the side walls. Consequently, reduced material content is required to support the integrity of the container and the container may thus be cheaper to manufacture.

Where in the foregoing description, reference has been made to specific components or integers of the invention having known equivalents then such equivalents are herein incorporated as if individually set forth.

Although this invention has been described by way of example and with reference to possible embodiments thereof, it is to be understood that modifications or improvements may be made thereto without departing from the scope of the invention as defined in the appended claims.

The invention claimed is:

1. A container suitable for containing liquid and having at least one controlled deflection flex panel for accommodating pressure change induced in the container, said flex panel having longitudinal and transverse extents defining a plane of said flex panel, said flex panel having at least one flexure region and at least one flexure initiator region positioned longitudinally away from said flexure region, said flexure initiator region having a flatter arc of curvature projecting away from said plane than said flexure region to provide a longitudinal change of curvature, said regions merging together within the panel so that said flexure region can flex inwardly relative to said plane in response to pressure changes, wherein the amount of arc progressively changes in response to increasing pressure change in the container.

2. A container as claimed in claim 1 adapted to contain liquid at a temperature elevated above room temperature.

3. A container as claimed in claim 2 wherein said flex panel is able to accommodate vacuum pressure caused during a cooling of said liquid at elevated temperature.

4. A container as claimed in claim 2 wherein the flex panel is adapted to allow deflection of the initiator region upon cooling of the liquid.

5. A container as claimed in claim 1 wherein the or each flexure region is positioned towards a longitudinal end or a respective longitudinal end of said flex panel.

6. A container as claimed in claim 1 wherein the or each initiator region is positioned towards a longitudinal end of said flex panel.

7. A container as claimed in claim 1 wherein in response to increasing pressure change in the container said initiator region progressively lessens in amount of projection away from said plane.

8. A container as claimed in claim 1 wherein in response to increasing pressure change in the container said flexure region progressively lessens in amount of projection away from said plane.

9. A container as claimed in claim 1 wherein said flex panel is invertible.

10. A container as claimed in claim 1 wherein the projection is in an outward direction.

11. A container as claimed in claim 1 wherein the flex panel is located between relatively inflexible land areas.

12. A container as claimed in claim 1 wherein at least one initiator region includes a substantially flattened portion.

13. A container as claimed in claim 12 wherein the flattened portion is located at a distal end of said initiator region relative to the rest of the flex panel.

14. A container as claimed in claim 1 wherein a boundary between said initiator region and the remainder of the flex panel is substantially arcuate in a circumferential direction of the panel.

15. A container as claimed in claim 1 wherein the initiator region is located substantially towards a central portion of said flex panel and between two said flexure regions extending away therefrom.

16. A container suitable for containing liquid and having at least one controlled deflection flex panel for accommodating pressure change induced in the container, wherein said flex panel has longitudinal and transverse extents defining a plane of said flex panel, said longitudinal and transverse extents being relative to a longitudinal axis of said container, said flex panel having a flexure region projecting away from said plane and a flexure initiator region positioned longitudinally away from said flexure region , said flexure initiator region having a lesser amount of arc projecting away from said plane than said flexure region, said regions merging longitudinally together within the panel with the amount of arc progressively increasing from said initiator region to said flexure region so that said initiator region can flex inwardly relative to said plane and wherein in response to pressure changes the amount of arc changes and causes said flexure region to progressively reduce in said amount of arc in response to increasing pressure change in the container.

17. A container suitable for containing liquid and having at least one controlled deflection flex panel for accommodating pressure change induced in the container, said flex panel having longitudinal and transverse extents defining a plane of said flex panel, said longitudinal and transverse extents being relative to a longitudinal axis of said container, said flex panel having a flexure region projecting away from said plane and a flexure initiator region positioned longitudinally away from said flexure region, said flexure initiator region having a lesser amount of arc projecting away from said plane than said flexure region, said regions merging longitudinally together within the panel so that said initiator region can flex inwardly relative to said plane and wherein in response to pressure changes the amount of arc changes and causes said flexure region to progressively reduce in said amount of arc in response to increasing pressure change in the container.

18. A method of controlling the compensation for pressure change in a hot filled plastic container during its cooling, said method comprising the steps of providing the container with at least one controlled deflection panel having at least one flexure region and at least one flexure initiator region, said method further comprising providing the initiator region (s) with a flatter arc of curvature projecting away from a plane of the panel than the arc of curvature of the flexure region (s) to provide a progressive change in the amount of arc which will compensate for the pressure change as the cooling proceeds.

19. A method of forming a container suitable for containing liquid, the method comprising forming at least one controlled deflection flex panel configured for accommodating pressure change induced in the container, wherein said flex panel is formed to have longitudinal and transverse extents defining a plane of said flex panel, to have at least one flexure region and to have at least one flexure initiator region positioned longitudinally away from said flexure region, wherein said flexure initiator region has a flatter arc of curvature projecting away from said plane than said flexure region to provide a longitudinal change of curvature, said regions merging together within the panel so that said flexure region can flex inwardly relative to said plane in response to pressure changes, and wherein said flex panel is further formed so that the amount of arc progressively changes in response to increasing pressure change in the container.

* * * * *